US006294050B1

(12) United States Patent
Oechsle et al.

(10) Patent No.: US 6,294,050 B1
(45) Date of Patent: Sep. 25, 2001

(54) DRYING END OF A MACHINE FOR THE PRODUCTION OF A MATERIAL WEB AND METHOD OF DRYING A MATERIAL WEB

(75) Inventors: Markus Oechsle, Bartholomae; Tri Chau-Huu; Roland Mayer, both of Heidenheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/393,691

(22) Filed: Sep. 10, 1999

(30) Foreign Application Priority Data

Sep. 11, 1998 (DE) ..... 198 41 768

(51) Int. Cl.[7] ..... D21F 11/00

(52) U.S. Cl. ..... 162/207; 162/359.1; 162/290; 162/361; 162/357; 162/297; 162/206; 34/117; 34/119; 34/123; 34/124

(58) Field of Search ..... 162/207, 359.1, 162/290, 361, 375, 297, 206; 34/117, 119, 123, 124

(56) References Cited

U.S. PATENT DOCUMENTS

| | | | |
|---|---|---|---|
| 3,303,576 | 2/1967 | Sisson . | |
| 3,418,723 | 12/1968 | Burgess et al. . | |
| 3,447,247 | 6/1969 | Daane et al. . | |
| 3,751,823 | 8/1973 | Hansen . | |
| 3,851,407 | 12/1974 | Rantala . | |
| 3,919,783 | 11/1975 | Cirrito . | |
| 4,033,049 * | 7/1977 | Schiel | 34/115 |
| 4,036,684 | 7/1977 | Schmitt et al. . | |
| 4,297,794 | 11/1981 | Luthi . | |
| 4,361,466 | 11/1982 | Wong et al. . | |
| 4,462,868 * | 7/1984 | Oubridge | 162/280 |
| 5,383,288 | 1/1995 | Ilmarinen . | |
| 5,678,321 | 10/1997 | Deshpande et al. . | |
| 5,799,409 * | 9/1998 | Chau-Huu | 34/117 |
| 5,865,955 | 2/1999 | Ilvespää et al. . | |
| 5,933,980 | 8/1999 | Deshpande et al. . | |
| 6,004,430 | 12/1999 | Ilvespää et al. . | |

FOREIGN PATENT DOCUMENTS

| | | |
|---|---|---|
| 355907 | 8/1979 | (AT) . |
| 1813462 | 7/1969 | (DE) . |
| 19707366 | 9/1969 | (DE) . |
| 1629033 | 10/1970 | (DE) . |
| 2155386 | 6/1972 | (DE) . |
| 2203621 | 8/1973 | (DE) . |
| 2357183 | 5/1975 | (DE) . |
| 2832840 | 2/1979 | (DE) . |
| 3215515 | 11/1982 | (DE) . |
| 3615152 | 11/1987 | (DE) . |
| 3807858 | 9/1989 | (DE) . |
| 19642526 | 4/1998 | (DE) . |
| 19651191 | 6/1998 | (DE) . |
| 0559628 | 9/1993 | (EP) . |
| 694648 | 1/1996 | (EP) . |
| 97/13031 | 4/1997 | (WO) . |
| 97/45588 | 12/1997 | (WO) . |
| 00/00693 | 1/2000 | (WO) . |

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Drying end of a machine for the production of a material web such as paper or cardboard. The drying end includes at least one impact flow drier configured to bombard at least one surface of the material web with hot air or hot steam impact flow. Also provided is a method for drying a material web including bombarding the material web on at least one surface with hot air or hot steam impact flow, via at least one impact flow drier.

122 Claims, 6 Drawing Sheets

DRYING END OF A MACHINE FOR THE PRODUCTION OF A MATERIAL WEB AND METHOD OF DRYING A MATERIAL WEB

CROSS-REFERENCE TO RELATED APPLICATIONS

The present application claims priority under 35 U.S.C. §119 of German Patent Application No. 198 41 768.3, filed on Sep. 11, 1998, the disclosure of which is expressly incorporated by reference herein in its entirety.

BACKGROUND OF THE INVENTION

1. Field of the Invention

The invention relates to a method for drying a material web and to a drying end of a machine for the production of a material web, and in particular, a paper or cardboard web.

2. Discussion of Background Information

During drying, in a known multi-cylinder drying end, a paper web is guided over a plurality of steam-heated cylinders and often also over suction rolls. At the beginning of the drying process, when the paper web still does not have adequate strength, problems frequently occur with regard to web guidance which are often attributed to the fact that the still-moist web continues to adhere to the smooth contact surfaces of the drying end, the smooth surfaces being necessary for adequate heat transfer. This adhesion often results in breakage of the web as well as excessive stretching of the edges of the web. Care must thus be taken so that drying occurs more slowly, which means that the necessary drying end must have a longer overall path. These problems are more pronounced at higher web speeds.

SUMMARY OF THE INVENTION

The present invention provides a drying end of a machine for the production of a material web, and a method of drying a material web. The drying end of a machine for the production of a material web has at least one impact flow drier configured to bombard at least one surface of the material web with at least one of hot air and hot steam impact flow. The material web may be paper or cardboard. Also, an open support surface over which the material web is guided by the surface opposite the surface bombarded with the impact flow, may be provided. A steam suction device may be provided on at least one impact flow drier, the impact flow drier being configured to simultaneously dry the material web and remove steam.

The drying end may further include a cover wire positioned between the material web and the impact flow drier, wherein the cover wire and the material web may be guided together over the support surface. The invention may further have a support roll over which the material web may be guided, and wherein the open support surface may be the surface of the support roll, a covering over the support roll, a coating of the support roll or a continuous belt adapted for guiding over the support roll. The support roll may have an external diameter in the range from approximately 2 meters to approximately 10 meters.

Additionally, the open support surface may include a surface of a continuous belt for guidance over the support roll, the continuous belt having an air-permeable wire or air-impermeable transport belt. The open support surface may also include a shrink wire installed on the support roll. Also, the support roll may have a solid sleeve design or a spoke/lattice design.

The open support surface may further include a surface of a support belt configured to be guided over a plurality of support rolls. Also, the support rolls may be arranged in an arc. The open support surface may further be divided into a plurality of sections, each section being flat. The support surface may further include a removal zone, and may bombard the material web with compressed air through the support surface at least in the removal zone, whereby the web may be removed from the support surface.

Further, the support belt may be constructed of metal or plastic. The support belt may be air-impermeable or constructed of an air-impermeable fabric. The support belt may be configured to be guided in the shape of a polygon, and may lie in either a plane or a curve.

The support roll may have perforations or a lattice structure, and may guide the material web thereover, the support roll bombarding the web with compressed air. The support roll may further include a removal zone, and the support roll may be bombarded on the inside thereof with compressed air at least at the removal zone, whereupon the web may be removed from the support surface.

The cover wire may be positioned between the material web and the impact flow drier, wherein the cover wire and the material web may be guided together over the support surface, such that the web and the cover wire may be removed from the support roll. Also, the cover wire may be constructed of metal or plastic.

The temperature of the compressed air may be higher than approximately 20° C. Also the hot air and hot steam impact flow may have a temperature in the range from approximately 150° C. to approximately 450° C., and may further be generated by an impact flow drier. The flow speed of the hot air and hot steam impact flow may be in the range from approximately 60 meters/second to approximately 120 meters/second.

Also, the impact flow drier may include a plurality of nozzles and/or a drier hood. Each nozzle may by spaced by a fixed and identical distance from the material web during operation. The distance of each the nozzle from the material web may be in the range from approximately 10 mm to approximately 50 mm.

The invention may further include at least two support rolls positioned in series in the direction of web travel, each support roll being operatively arranged with a respective impact flow drier. Also, each of the support rolls may have a different diameter. The support rolls may lie in a single plane or along a curved surface.

At least one impact flow drier may have a drier hood subdivided into zones according to a direction of web travel or at right angles to a direction of web travel. The impact flow drier may be positioned above the material web and may be operatively arranged with a respective support surface positioned below the material web. The impact flow drier may be positioned below the material web and may be operatively arranged with a respective support surface positioned above the material web. Also, at least one impact flow drier may be provided in a starting zone.

The material web may be simultaneously bombarded on both surfaces in at least one zone by hot air or hot steam impact flow. Additionally, the material web may be guided through at least one zone between two wire belts. The material web may further be guided through the zone along a linear or curved path. Also, the wire belt may be guided over a plurality of support rolls. The wire belt may be constructed of metal or plastic.

The invention may further include at least one drying group having at least one drying cylinder, wherein an impact flow drier may be located upstream of the at least one drying group in a direction of web travel, and the material web may have a solids content which may be greater than approximately 55% to approximately 70% upon reaching the at least one drying cylinder. Also, a one-row drying group and at least one two-row drying group may be included.

An end zone may be provided, wherein an impact flow drier may be provided in the end zone. Also, an evaporation zone may be provided, wherein an impact flow drier may be provided at the evaporation zone.

Further, at least two impact flow driers may be positioned in series in a direction of web travel, the flow driers bombarding the material web from opposite web surfaces with hot air or hot steam impact flow. Alternatively, the flow driers may bombard the material web from one web surface.

At least two intermediate impact flow driers positioned opposite each other and configured to bombard the material web from opposite surfaces may be provided. Also, at least one intermediate impact flow drier may be provided that bombards the material web from opposite web surfaces with hot air or hot steam impact flow, and the intermediate impact flow drier may be positioned intermediate the two impact flow driers. Alternatively, at least one intermediate impact flow drier may be provided that bombards the material web from opposite web surfaces with hot air or hot steam impact flow, the intermediate impact flow drier being positioned intermediate the at least two impact flow driers.

Additionally, at least one group of three impact flow driers may be provided, each group having at least one sequentially positioned opposing impact flow drier, wherein the material web may be guided through the group along a first arc, a plane or a curved surface, and along a second arc. A plurality of impact flow driers sequentially positioned in a web travel direction may be provided, the plurality of impact flow driers alternatingly bombarding opposite surfaces of the material web.

The method of the present invention includes bombarding the material web on at least one surface with at least one of hot air and hot steam impact flow, via at least one impact flow drier. The method may also include guiding the material web over an open support surface by the surface of the material web opposite the surface bombarded with the impact flow. Additionally, the method may include simultaneously drying the material web and removing steam via a steam suction device provided on an impact flow drier. The method may further include guiding the material web over the support surface together with a cover wire positioned between the material web and the at least one impact flow drier.

Further, the method may include guiding the material web over a support roll, and wherein the open support surface comprises one of the surface of the support roll, a covering over the support roll, a coating of the support roll and a continuous belt adapted to be guided over the support roll. The support rolls may further be arranged in an arc. The support belt may be guided in the shape of a polygon.

The method may further include bombarding the material web with compressed air through the support surface at least in a removal zone, and removing the web from the support surface. Also, the method may include guiding the material web over a support roll, the support roll having one of perforations and a lattice structure, and bombarding the support roll from the inside with compressed air, at least in zones. The method may also include bombarding the support roll with compressed air, at least in a removal zone, and removing the web from the support roll. The method may further include guiding a cover wire and the material web together over the support surface, the cover wire positioned between the material web and the at least one impact flow drier, and removing the web and cover wire from the support roll.

Also, the method may include positioning at least two support rolls in series in the direction of web travel, with each support roll being operatively arranged with a respective impact flow drier. The method may still yet include positioning at least one impact flow drier above the material web, and operatively arranging the at least one impact flow drier with a respective support surface positioned below the material web. The method may also include positioning at least one impact flow drier below the material web, and operatively arranging the at least one impact flow drier with a respective support surface positioned above the material web.

Furthermore, the method may include simultaneously bombarding both surfaces of the material web in at least one zone by hot air or hot steam impact flow. Also, the material web may be guided through the at least one zone between two wire belts. The material web may also be guided through the at least one zone along a linear or curved path. At least one wire belt may be guided over a plurality of support rolls. An impact flow drier may also be provided in a starting zone.

At least one impact flow drier may be positioned upstream of at least one drying group in a direction of web travel. Also, at least one one-row drying group or at least one two-row drying group may be provided. Further, an impact flow drier may be provided in an end zone. An impact flow drier in an evaporation zone may be provided.

Additionally, at least two impact flow driers in a direction of web travel may be positioned in series, and the material web may be bombarded, by at least two impact flow driers, from opposite web surfaces with hot air or hot steam impact flow. Alternatively, the material web may be bombarded from the same web surface.

Also, the method may include positioning at least two intermediate impact flow driers opposite each other, and bombarding the material web from opposite web surfaces. The method may further include positioning at least one intermediate impact flow drier intermediate the at least two impact flow driers, and bombarding the material web from opposite web surfaces by an intermediate impact flow drier.

The method may also include guiding the material web through at least one group along a first arc, each group having three sequentially-positioned impact flow driers, at least one of which is an opposing impact flow drier, guiding the material web through one of a plane and a curved surface, and guiding the material web along a second arc. The method may also include sequentially positioning a plurality of impact flow driers in a web travel direction and alternatingly bombarding, by the plurality of impact flow driers, opposite surfaces of the material web.

The present invention provides a drying end which ensures both an optimal drying rate (and thus the shortest possible overall length of the drying end), as well as reliable web guidance.

The invention includes at least one impact flow drier through which the material web can be bombarded on at least one web surface with hot air and/or hot steam impact flow.

Using the present invention, it is no longer necessary to guide a still-moist material web over smooth contact surfaces to achieve adequate heat transfer. By avoiding smooth contact surfaces at the beginning of drying, the danger of web breakage as well as excessive stretching of the web edges is virtually eliminated. In particular, higher drying rates are possible, resulting in the total length of the path of the drying end being shortened. Drying performance at the beginning of the drying process is limited only by a negative effect on paper quality at a high drying speed and is no longer limited by the web guidance of the moist paper web. Moreover, with a flexible and rapidly regulable impact flow drier, paper quality can be better managed. Thus, correction of moisture conditions is possible at the beginning of the drying phase by heating and drying. Since pressing the web against heating surfaces is unnecessary, any transverse shrinkage prevention may be better controlled or varied.

In a certain embodiment of the invention, the material web with the web surface opposite the web surface bombarded with impact flow is guided over an open (i.e., non-smooth) support surface. The still-moist material web does not adhere to the support surface, thereby eliminating web breakage, as well as excessive stretching of the web edges.

At least one impact flow drier is provided with steam suction for simultaneous steam removal. Consequently, a change from heating to steam removal is unnecessary. By eliminating the additional steam removal surface, the overall length of the path is further reduced.

The material web may be guided over the support surface along with a cover wire present between the web and an impact flow drier. The material web is thus supported by the cover wire. The material web is held to the support surface by this cover wire and is further transported in the event of a possible break, so that no broken paper is trapped in the impact flow drier.

In the present invention, the material web is guided in over a large support roll, and the open support surface is formed either by the surface itself, or by covering or coating of the support roll, or by guiding the surface of a continuous belt over the support roll.

The large support roll ensures reliable and exact guidance with a constant radius of curvature. Since the support roll does not have to be a pressure container, it can be relatively large in order to provide a correspondingly larger drying surface. For example, the support roll can have an external diameter in the range from approximately two to approximately ten meters.

If the open support surface is formed by the surface of a continuous belt guided over the support roll, this continuous belt may be formed by an air-permeable wire. An air-impermeable transport belt, however, may also be used. Moreover, the open support surface may be formed by a shrink wire installed on the support roll.

Also, the open support surface may be formed by the surface of a support belt guided over a plurality of support rolls. In such a configuration, the open support surface may be guided in a plane at least in sections, e.g., over a large number of support rolls. Moreover, an open support surface that is slightly curved, at least sectionally, may also be used.

The support rolls may be arranged in an arc. The support belt may also be guided in the shape of a polygon.

To facilitate the release of the material web from a support surface, the material web may be bombarded, at least in the removal zone, with compressed air through the support surface.

If the material web is guided over a support roll, the latter may be perforated or provided with a lattice structure, and bombarded on the inside, at least in some areas, with compressed air or the like. Such a support roll may then be bombarded from the inside with compressed air, at least in the removal zone, in which the material web and possibly also a cover wire is removed from the support roll. The temperature of the compressed air is generally greater than approximately 20° C.

In a certain aspect of the invention, at least one impact flow drier may be provided that generates a hot air or hot steam impact flow with a temperature in the range from approximately 150° C. to approximately 450° C.

At least one impact flow drier with a plurality of high-performance nozzles, may be used. During operation, these high-performance nozzles have a constant generally equal distance from the material web. This distance can range, for example, from approximately 10 mm to approximately 50 mm. At least one impact flow drier may be provided with at least one drier hood, which may be subdivided into zones in the direction of web travel and/or at right angles to the direction of web travel. By using such zoned heating and drying, paper quality can effectively be managed. Specifically, corrections of moisture conditions are possible.

At least one impact flow drier may be provided in a starting zone of the drying end. Additionally or alternatively, at least one such impact flow drier can further be provided in a primary evaporation zone of the drying end. Additionally or alternatively, at least one impact flow drier can further be provided in an end zone of the drying end. This arrangement yields an even higher drying rate, such that the web travel path in the drying end is further shortened overall.

At least one drying group is provided with at least one drying cylinder and at least one impact flow drier is preferably arranged upstream before this drying group in the direction of web travel, such that the material web, upon reaching the first drying cylinder, preferably already has a solids content greater than approximately 55% to approximately 70%.

For example, after transfer from the press and drying on a support roll drier, the material web can be dried simultaneously from both web surfaces along one or a plurality of linear or slightly curved sections by impact flow driers opposite each other, to a solids content of approximately 55% to approximately 70%. For two-surfaced drying, instead of the two impact flow driers opposite each other, even a single drier surrounding the web and acting on both web surfaces may be provided. Until the desired level of dryness is reached, the material web is supported by a non-smooth surface such that the still-moist material web does not have to be drawn at any point from a smooth surface. Then, for example, a multi-cylinder drying group may follow. It is also possible, for example, to guide a cover wire which may be used both through a support roll impact flow drier and through a subsequent linear or slightly curved impact flow drier unit. A second wire may, for example, also be fed as a support wire to the straight impact flow drier unit.

Instead, the paper web may also be transferred to two new wires. In the zone of the straight or slightly curved web guidance, the material web may, for example, also be bombarded on both web surfaces with hot air or hot steam impact flow. In this zone of linear or slightly curved web guidance, it is also possible to provide an impact flow drier on only one web surface, while a large number of support rolls may be arranged on the opposite web surface. It is also possible for the material web to be bombarded from one web surface with hot air or hot steam impact flow, with a plurality of support rolls arranged on this side. In such an arrangement, bombardment occurs in particular through the zone between the support rolls. The material web may be bombarded at various locations from the same web surface or even from different surfaces with a respective hot air or hot steam impact flow.

With the drying end according to the present invention, supported, pull-free web guidance is possible, particularly up to, for example, approximately 60% to approximately 70% solids content, such that the breaking problems in this zone are eliminated. Higher drying rates are possible, such that a correspondingly shorter web travel path and a more compact drying end are obtained. Negative effects on the paper characteristics are virtually excluded. The impact flow driers can, in particular, be used after pressing with subsequent one-row drying groups. If necessary, the variants described can extend all the way to the end of the drying end. However, use of the impact flow drier is also conceivable in a primary evaporation zone of the drying end. The use of impact flow driers in conjunction with multi-row drying groups is also conceivable.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

Figure 1:
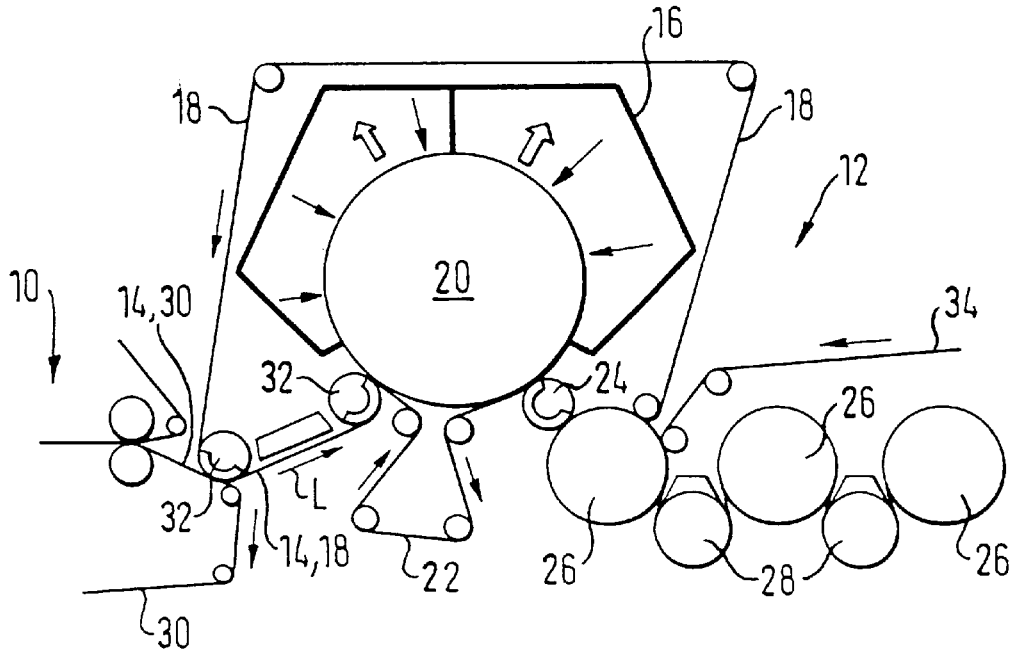
FIG. 1 shows a first embodiment of a drying end with an impact flow drier opposite a relatively large support roll.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Referring to the drawings wherein like numerals represent like elements, FIGS. 1 through 9, show a section of a drying end 12 that is subsequent to a press section 10 of a machine for the production of a material web 14, such as a paper or cardboard web.

In a first embodiment shown in FIG. 1, the drying end 12 includes an impact flow drier 16 positioned above the material web (the drier is positioned about an upper portion of the circumference of a large support roll 20), whereupon the material web 14 is bombarded with a hot air and/or hot steam impact flow on one surface of the material web. The material web 14 is guided with its surface opposite the impact flow drier 16 (i.e, the bottom surface) over an open (i.e., not smooth), support surface. The material web 14 is guided along with a cover wire 18 over the large support roll 20 by a bottom wire 22 on the opposite web surface (i.e, the bottom surface). In the present embodiment, the bottom wire 22 forms the open support surface. Subsequent removal of the material web 14 and the cover wire 18 is facilitated by this continuous bottom wire 22.

In a removal zone downstream from the large support roll 20, the material web 14 is guided, along with the cover wire 18, around a suction roll 24, whereupon it is fed to a one-row drying group having a plurality of drying cylinders 26, with suction rolls 28 positioned therebetween. As can be seen in FIG. 1, the cover wire 18 is again separated from the material web 14 in the zone of the first drying cylinder 26.

In the present embodiment, the material web 14 is transferred in a closed path from the last pressing nip of the press section 10 to the impact flow drier 16. The material web 14 is supported by the cover wire 18 and is guided on the large support roll 20, over which the bottom wire 22 runs. The large support roll 20 ensures reliable and exact guidance of the two wires 18, 22 with the material web 14 therebetween, further assuring a constant radius of curvature. Damage to the material web 14 is thus prevented, as only slight wire tension is required.

Due to the fact that the support roll 20 does not need to be a pressure container, the support roll can be made substantially larger, thereby creating a larger drying surface. It is preferred that the cover wire 18 is open, thin, and resistant to high temperatures in order to provide good impact flow drying. The cover wire serves to hold the material web 14 to the support roll 20 and to continue to transport the web even in the event of a break, such that no broken paper is trapped in the drier hood of the impact flow drier 16. The impact flow drier may also be provided with a plurality of high-performance nozzles. The bottom wire 22 facilitates removal of the material web 14 from the support roll 20. The bottom wire 22 does not have to be as open as the cover wire 18, but should be air-impermeable. Both wires 18, 22 can be cleaned at the return path.

The drier hood of the impact flow drier 16 may be subdivided into longitudinal zones and may have transverse zones for adjusting the moisture concentrations. The drier hood should be subdivided as much as possible such that it can be lifted by the support roll 20. During operation, the high-performance nozzles have a constant distance from the surface of the material web 14. This distance may range generally from approximately 10 mm to approximately 50 mm.

In the present embodiment, the material web 14 is fed to the support roll 20 by a pressing felt 30 of the press section 10 in a closed path supported by the cover wire 18. The cover wire 18 is guided to the support roll 20 over a suction roll 32 in the zone of the transfer of the material web 14 from the pressing felt 30 and also in the zone of the transfer of the material web 14.

After being guided through the press section 10, the material web 14 to be dried is guided between two open temperature-resistant wires 18, 22 around a large support roll 20. The drying hood of an impact flow drier 16 is mounted over the large support roll 20 (i.e., is mounted about a portion of the circumference of the support roll including the upper portion of the upper circumference thereof) and is provided with high-performance nozzles. The flow speed of the hot air and/or hot steam impact flow may be, for example, in a range of approximately 60 m/s to approximately 120 m/s. The temperature of this impact flow may be, for example, in a range of approximately 150° C. to approximately 450° C. Alternatively, gas- or steam-heated hot air or superheated steam may be used. After reaching a solids content of approximately 55% to approximately 70%, the material web 14 has adequate strength and the drying process is completed in a preferably one-row (possibly also two-row) cylinder drying group. To prevent curling (i.e., drying from both web surfaces) or to increase the drying performance without lengthening the drying end, a support roll-impact flow drier 16 may alternatively or additionally be incorporated into the end section of the drying end 12 and/or into the primary evaporation zone.

Thus, at the beginning of the drying process, removal of the moist material web 14 from smooth surfaces is unnecessary. The web is reliably guided in the critical zone up to a solids content of, for example, 55% to approximately 70%. The supply of heat (e.g., via impact nozzle flow) and the removal of steam (e.g., via suction openings) occur simultaneously during impact flow drying such that alternating between heating and evaporation is unnecessary. The elimination of an additional evaporation surface thus results in a shorter distance of travel.

Since the support roll 20 does not need to be embodied as a pressure container, it can be substantially larger, which results in a larger drying surface. The drying performance at the beginning of drying is now limited only by negative effect on paper quality at an excessively high drying speed, and no longer by the guidance of the moist material web. The flexible and quickly regulatable impact nozzle hood that is subdivided into longitudinal and transverse zones enables control of paper quality. In particular, heating and drying at the beginning of web travel is possible as well as adjustment of moisture conditions. The prevention of transverse shrinkage can be varied by wire tension within predetermined limits since pressing against heated surfaces is not required.

Figure 3:
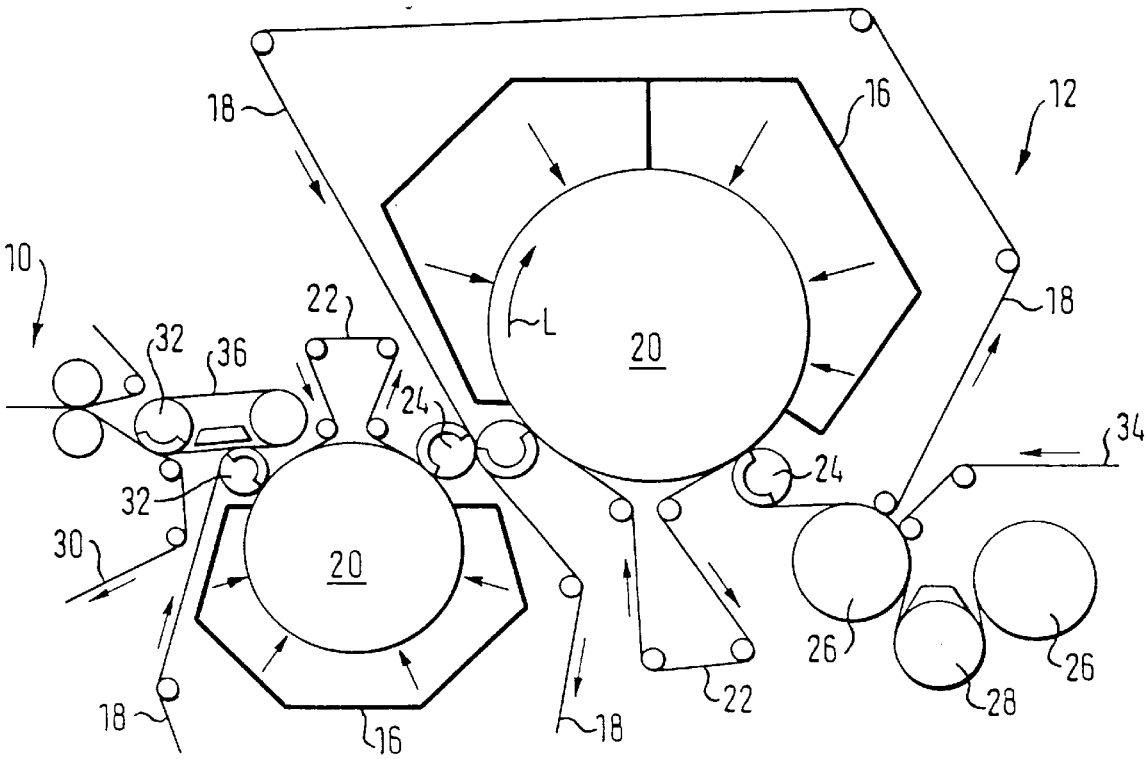
FIG. 3 shows a third embodiment of a drying end with two impact flow driers each opposite a large support roll, wherein the two support rolls have a different diameter.

The cover wire 18 may be made of plastic or metal. The bottom wire 22 may be replaced by an impermeable transport belt. However, to form the non-smooth support surface, a transport belt should have a corresponding open (i.e., not closed) surface. The transfer of the material web 14 from the press section 10 to the impact flow drier may also be supported by a transfer foil in addition to the cover wire 18, or may take place with an additional transfer felt 36, as shown in FIG. 3. The drying hood can also be operated with superheated steam. With the use of a solid sleeve support roll, the roll sleeve can be cooled via coolant channels or cooled from the inside. The continuous belt 22, provided with an open surface and embodied, for example, as a bottom wire, may then have multiple layers with a coarser structure on the surface facing the roll to remove condensed water. In the present case, the lifting of the material web 14 from the cover wire 18 during transfer to and removal from the impact flow drier 16 is prevented by suction rolls 32 or 24. Grooved rolls or transfer foils may also be provided for this purpose.

Figure 2:
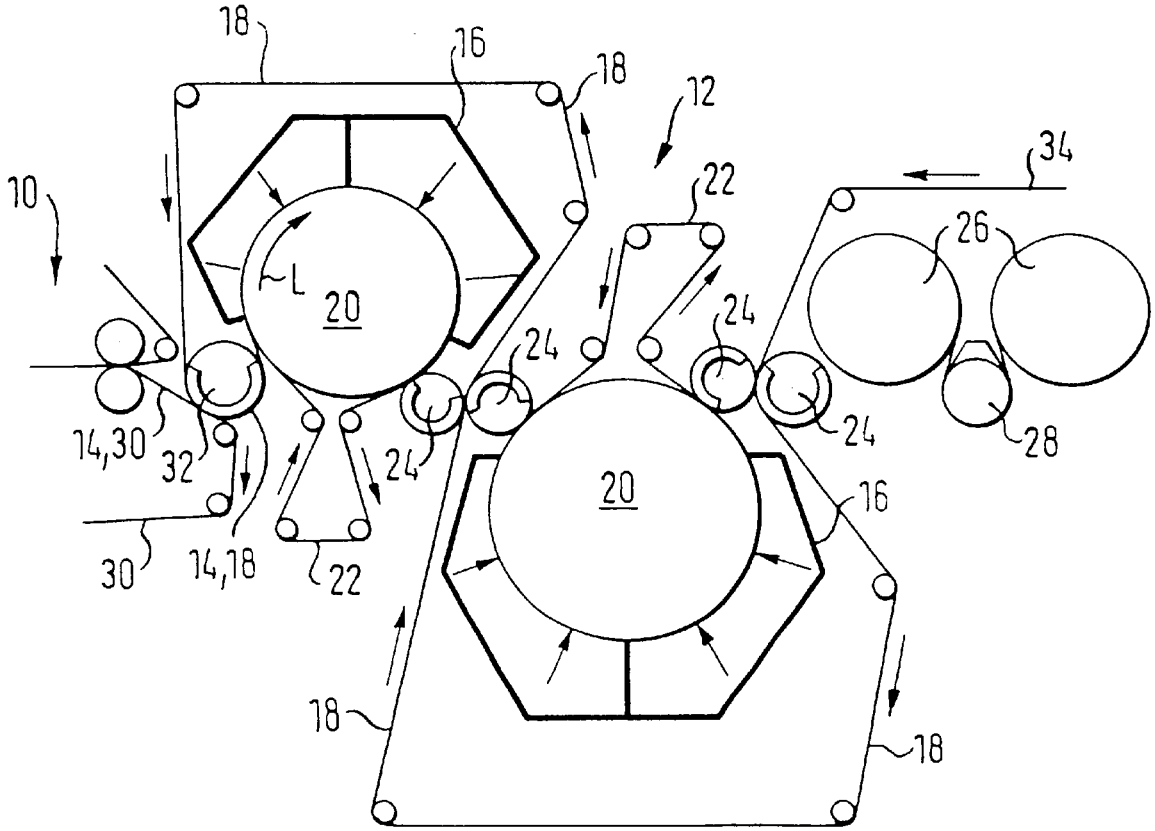
FIG. 2 shows a second embodiment of a drying end with two impact flow driers each opposite a large support roll, whereby the material web is bombarded from different web surfaces.

FIG. 2 depicts a second embodiment of a drying end 14 with two impact flow driers 16, each positioned opposite a large support roll 20. The driers 16 bombard the material web from opposite web surfaces. In the second embodiment, the front impact flow drier 16 (viewed in the direction of web travel L) is arranged above the back impact flow drier 16. The support roll 20 associated with the front impact flow drier 16 is positioned below the web and the support roll 20 associated with the back impact flow drier 16 is positioned above the web. Each of these two support rolls has, for example, a respective bottom wire 22 that travels substantially thereabout. The material web 14 is guided with the cover wire 18 over the large support roll 20. The material web 14 is then taken from the back cover wire 18 by a drying wire 34. In contrast, in the first embodiment shown in FIG. 1, the single cover wire 18 is separated from the material web 14 before the material web is brought together with the drying wire 34. Also, in the second embodiment, between the press section 10 and the front support roll 20, the material web 14 supported by the cover wire 18 is guided over only a single suction roll 32.

According to a third embodiment shown in FIG. 3, the drying end 14 following the press section 10 includes two impact flow driers 16 bombarding the material web 14 from opposite web surfaces and each being associated in operative engagement with a large support roll 20. In the third embodiment, the front impact flow drier 16 (viewed in the direction of web travel L) is arranged below the back impact flow drier 16. The front large support roll 20 is positioned above the web and the back large support roll 20 is positioned below the web. Moreover, in the third embodiment, the front support roll 20 has a smaller diameter than the back support roll 20. The transfer of the material web 14 from the press section 10 to the front impact flow drier 16 or to the large support roll 20 associated therewith occurs, without pulling, over an additional transfer felt 36. From this transfer felt 36, the material web is finally picked up by the cover wire 18 and are guided together over the front support roll 20, such that the cover wire 18 is guided over a suction roll 32 in the transfer zone. As with the second embodiment shown in FIG. 2, the material web 14 is transferred from the cover wire 18 that is guided over the front support roll 20, in the zone of two suction rolls 24, to the cover wire 18 that is guided over the back support roll 20. Also, the two large support rolls 20 each have a respective bottom wire 22 partially surrounding thereabout. In the second embodiment according to FIG. 2, the transfer of the material web 14 from the cover wire 18 that is guided over the back support roll 20 occurs directly onto the wire belt 34 in the zone of two suction rolls. In the third embodiment, the transfer of the material web 14 to the one-row drying group of drying cylinders 26 with associated suction rolls 28 occurs in the same manner as in the first embodiment (shown in FIG. 1).

The two large support rolls 20 are again each partially surrounded by a bottom wire 22, for example. With the consecutive drying of both web surfaces in the second and third embodiments, curling tendency is reduced.

Figure 4:
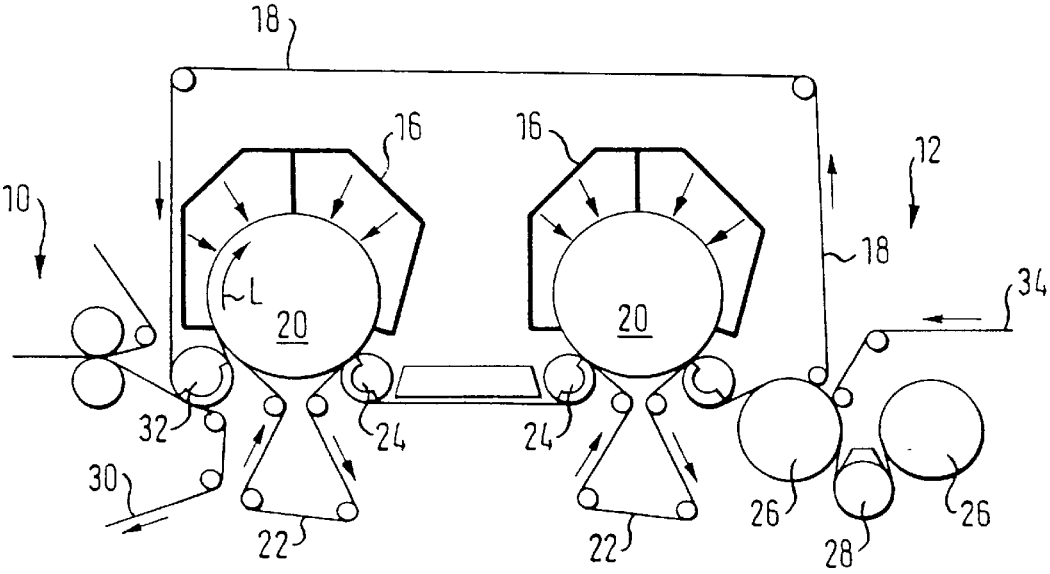
FIG. 4 shows a fourth embodiment of a drying end with two impact flow driers each opposite a relatively large support roll, whereby the material web is bombarded from the same web surface.

FIG. 4 shows a fourth embodiment of a drying end 14, with two upper impact flow driers 16, each associated with one large bottom support roll 20, which driers bombard the material web 14 on the same web surface. As shown in FIG. 4, a common cover wire 18 is guided over the two bottom support rolls 20. Each of the two support rolls 20 are partially surrounded by a respective bottom wire 22 that has an open support surface.

Figure 5:
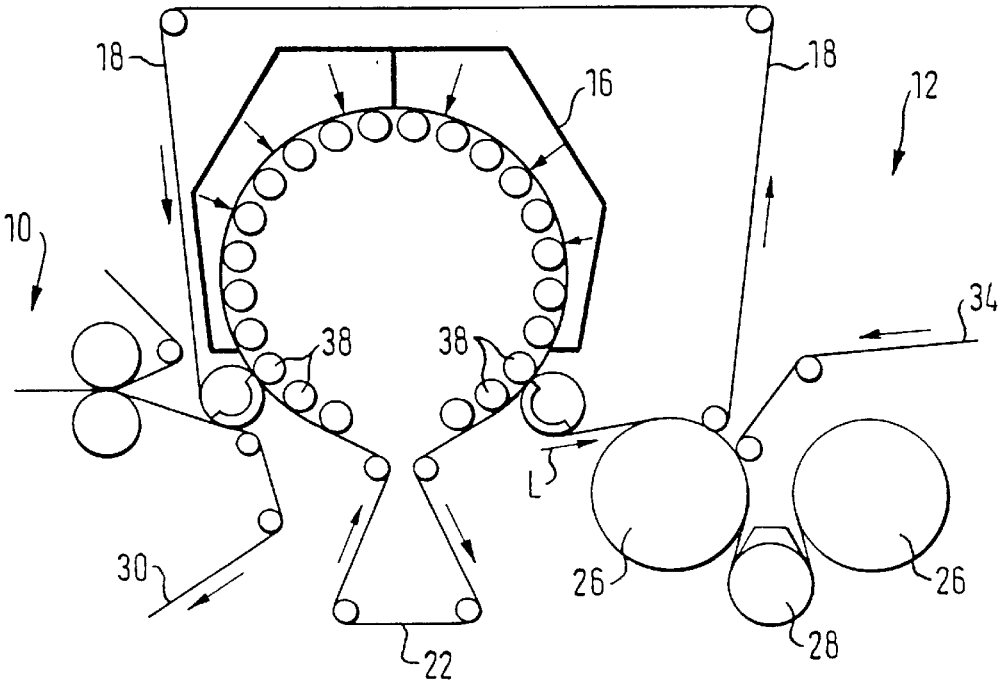
FIG. 5 shows a fifth embodiment of a drying end, wherein the material web is guided between a cover wire and a support belt over a plurality of support rolls arranged in an arc.

FIG. 5 shows a fifth embodiment of a drying end 14, in which the material web 14 is guided between the cover wire 18 and the bottom wire 22 over a plurality of support rolls 38 arranged in an arc. The open support surface facilitating the pickup of the material web 14 and cover wire 18 is formed by the bottom wire 22. The material web 14 is thus passed between the two wires 18, 22 to the impact flow drier 16 arranged above the web.

The bottom wire 22 may also be eliminated. Instead, the open support surface can be formed by the surface or a covering or coating of the support roll 20. For example, a shrink wire or the like can be applied to the support roll 20, or the relevant support roll 20 can be provided with a coated surface. The support roll 20 may, for example, have a solid sleeve or spoke/lattice design or even be a polygon.

As shown in FIG. 5, the web may be supported by a plurality of small support rolls 38 which are arranged in an arc such that the radius of curvature of the material web 14 is virtually constant between the wires 18, 22. The embodiments depicted can be used for incorporation into the primary evaporation zone or into the end section of a respective drying end 12, which also is true for the embodiments described below.

Figure 6:
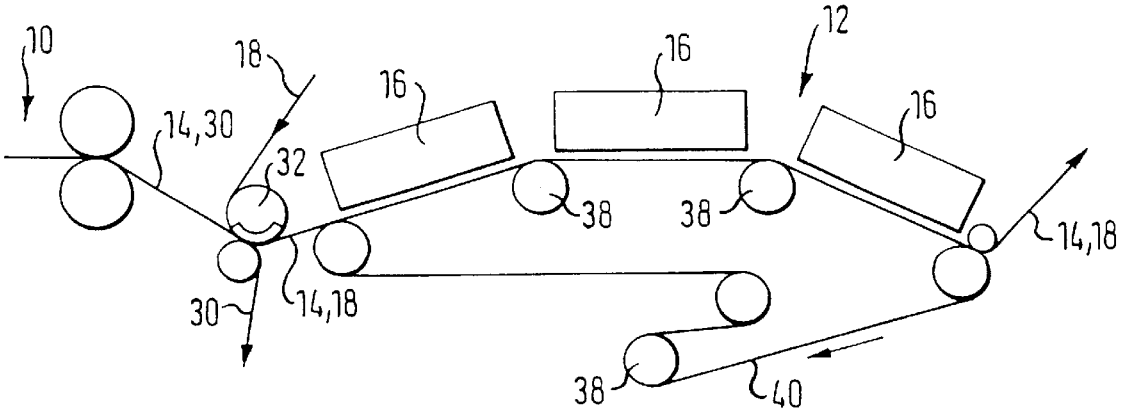
FIG. 6 shows a sixth embodiment of a drying end having a plurality of impact flow driers, which are positioned opposite a support belt guided over a plurality of support rolls.

FIG. 6 shows a sixth embodiment of a drying end 14 where a plurality of impact flow driers 16 are sequentially positioned opposite and above a common support belt 40, over which the material web 14 is guided along with a cover wire 18 formed by a drying wire. A support roll 20 (as discussed in the preceding first through fifth embodiments, supra) is replaced by the support belt 40 which is guided over a plurality of support rolls 38. The material web 14 is picked up by a pressing felt 30 of the press section 10, in closed guidance, in the zone of a suction roll 32. The web 14 is then fed by the cover wire 18 to the support belt 40. In the sixth embodiment, three impact flow driers 16 are provided, such that the material web 14 is guided in the zone of these impact flow driers 16 either in a straight line or in a slight curve.

In the sixth embodiment, which uses one-sided impact flow drying, the material web 14 attains, for example, a solids content of approximately 60% at the end of the last impact flow drier 16 (the right impact flow drier when viewed in FIG. 6).

The open support surface, which enables easy web removal, is formed by an open (i.e., not closed) surface of the support belt 40. This support belt 40 may, for example, be formed by a metal belt, a foil, or an air-impermeable fabric. In comparison with a support roll, the support belt 40 has the advantage, among others, that it is simpler to produce and is also more easily transportable. This support belt 40 is stable enough so that it does not vibrate upon bombardment by the impact flow drier 16.

Figure 7:
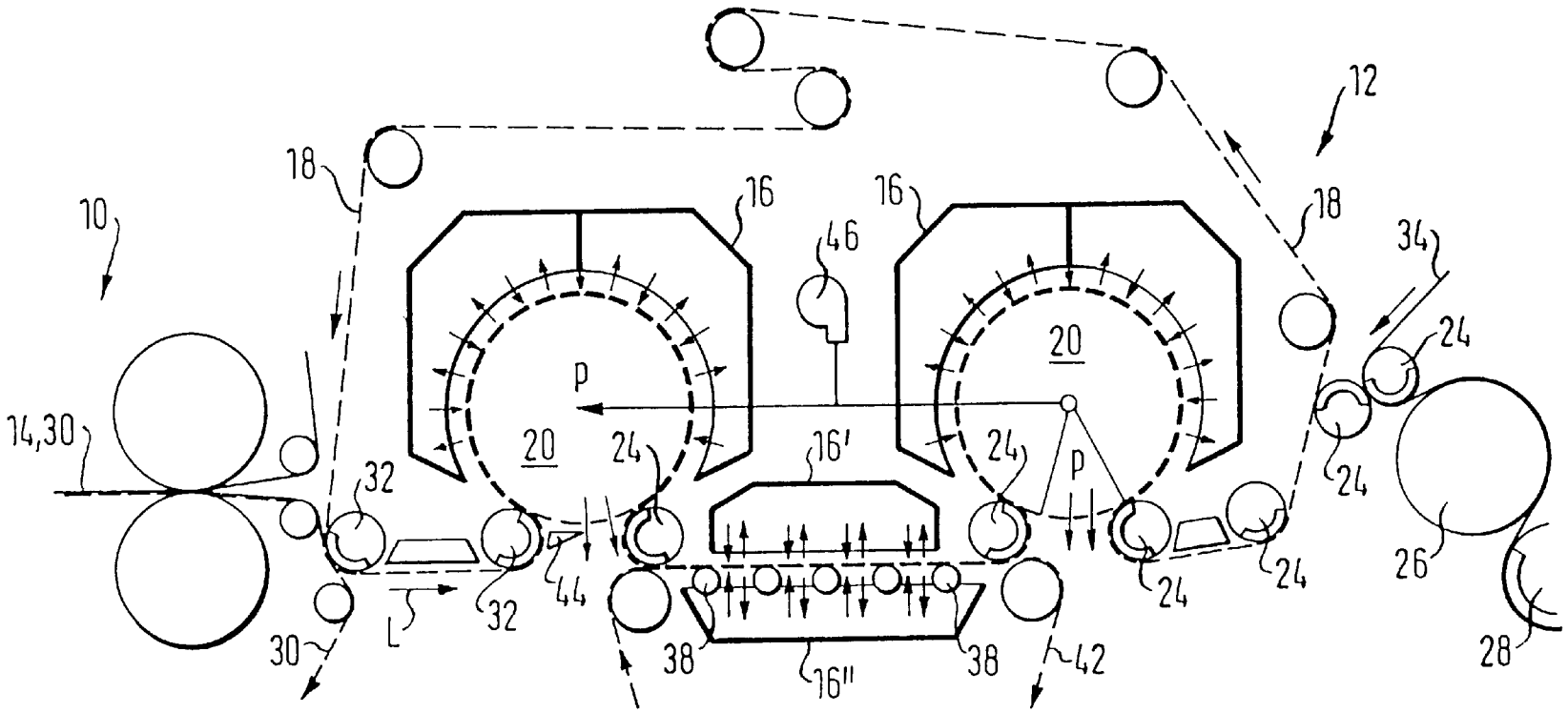
FIG. 7 shows a seventh embodiment of a drying end having two impact flow driers each positioned opposite a large support roll, and two impact flow driers opposite each other arranged therebetween for bilateral bombardment of the material web, such that the material web is guided directly between the two impact flow driers positioned opposite each other.

FIG. 7 depicts a seventh embodiment of the drying end 14, having two impact flow driers 16 positioned above the web 14, each drier being associated with a large support roll 20 positioned below the web. Also provided are two intermediate impact flow driers 16', 16" positioned one above the other, with the web traveling therebetween, for two-surfaced bombardment of the material web 14.

The material web 14 is taken from a pressing felt 30 of the press section 10 in the zone of a suction roll 32 by a porous cover belt 18 (preferably made of metal or plastic). The web is then fed in the zone of another suction roll 32 to the front large support roll 20, from which it is again picked up along with the cover wire 18 in the zone of another suction roll 24. The web is then guided between the cover wire 18 and another wire belt 42 made of metal or plastic along a straight path between the two impact flow driers 16', 16" positioned one above the other. The material web 14 and the cover wire 18 are again separated in the zone of a suction roll 24 from the lower wire belt 42 and guided onto the back support roll 20 positioned below the web, from which the web and cover wire are again removed in the zone of another suction roll 24 and guided in a line to a subsequent suction roll 24. In the zone of another suction roll 24, the material web 14 is separated from the cover wire 18 and picked up by a drying wire 34, whereby the web is again fed to a one-row drying group having a plurality of drying cylinders 26 and suction rolls 28.

The cover wire 18 is guided over both the front and the back large support rolls 20. In the zone of these two large support rolls 20, the material web is dried by the two impact flow driers 16 from the top of the web in each case. In contrast, two-surfaced drying of the material web 14 is accomplished by the two impact flow driers 16', 16" positioned therebetween. The two support rolls 20 are embodied as latticed support rolls coated with a shrink wire. The diameter of these support rolls 20 may be larger than approximately two meters.

The large support rolls 20 can be bombarded with compressed air from the inside to blow the material web 14 off at a respective removal point. The front support roll 20 (viewed in the direction of web travel L) is bombarded with internal pressure about the circumference thereof, whereas in the back support roll 20, internal pressure P bombardment is local and provided in the removal zone.

As shown in FIG. 7, a covering 44 is provided in the bottom zone of the front support roll not covered by the cover wire 18. The covering 44 serves to concentrate the pressurized air flow supporting removal at the removal zone. The transfer zone is, for example, approximately 500 mm wide. The compressed air temperature is, for example, greater than approximately 20° C. At least some of the impact flow driers 16, 16', 16" can be designed to generate a respective hot air or hot steam impact flow which speed is greater than or equal to approximately 100 meters/second and whose temperature is generally greater than or equal to approximately 15° C.

Figure 8:
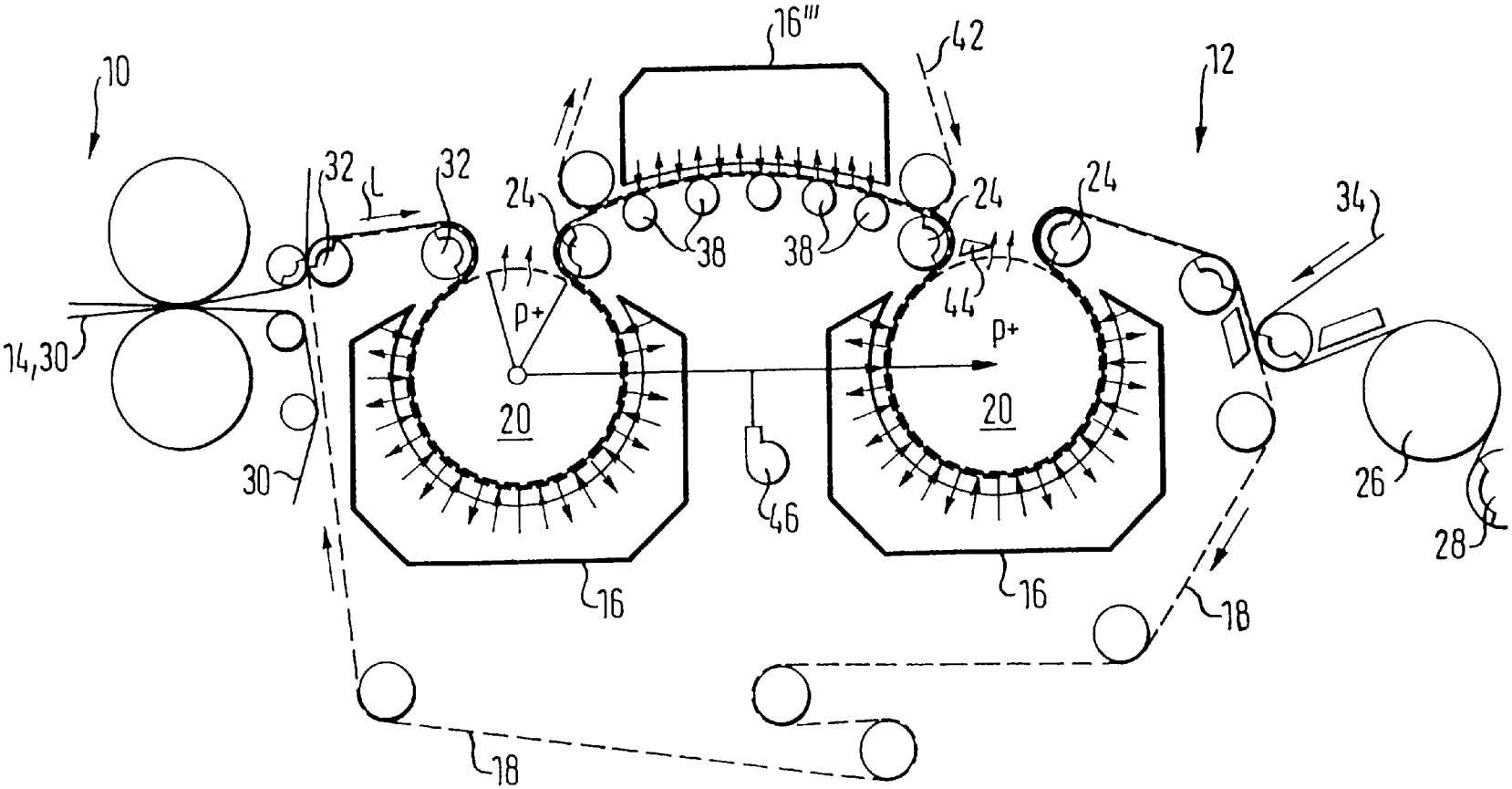
FIG. 8 shows an eighth embodiment of a drying end having two impact flow driers each opposite a large support roll and one impact flow drier arranged therebetween, whereupon the material web is guided along a slightly curved path.

In an eighth embodiment shown in FIG. 8, the material web 14 is first dried on a large support roll 20, then is dried on a slightly curved support surface and then dried again on a large support roll 20. To form the slightly curved support surface, a cover wire 18 that is guided over the two large support rolls 20 is also guided over a plurality of support rolls 38 positioned along a curve. The two impact flow driers 16 are each arranged below the respective support roll 20.

The material web 14 is thus dried from the bottom web surface by these two impact flow driers 16. Between these two impact flow driers 16 positioned below the web, an impact flow drier 16''' positioned above the web is provided and is arranged over the support rolls 38 and provides for drying the material web 14 from above. As shown in FIG. 8, the material web 14 is guided between the cover wire 18 positioned below the web and a wire belt 42 made of metal or plastic positioned above the web, along a path arched slightly upward toward the impact flow drier 16''' past this impact flow drier 16'''. A plurality of support rolls 38 positioned below the web in a curved plane are provided. In contrast to the seventh embodiment, in the present case no drying occurs at the support rolls 38. In the seventh embodiment, an impact flow drier 16 is also provided on the surface of the web facing the support rolls 38. Also, in the seventh embodiment, the support rolls 38 positioned below are arranged in a plane.

In the eighth embodiment, the support rolls 20 are formed by latticed support rolls, each being covered with a shrink wire. The diameter of these support rolls 20 may be larger than approximately two meters. An internal blast chamber associated with each support roll 20 is used to release the web and for cleaning the wire. In the present embodiment, local pressure bombardment P+ is provided with the front support roll 20, whereas the back support roll 20 is internally bombarded with pressure P+ about the circumference thereof. The back support roll 20 has a covering 44 to concentrate the flow of compressed air at the removal zone. The temperature of the compressed air may be greater than approximately 20° C. Following the back support roll 20 or the back impact flow drier 16, the material web 14 is removed from the cover wire 18 by a drying wire 34 and fed to a one-row drying group of a plurality of drying cylinders 26 and suction rolls 28. As shown in FIGS. 7 and 8, the two large support rolls 20 are supplied with compressed air by a common compressed air source 46.

Figure 9:
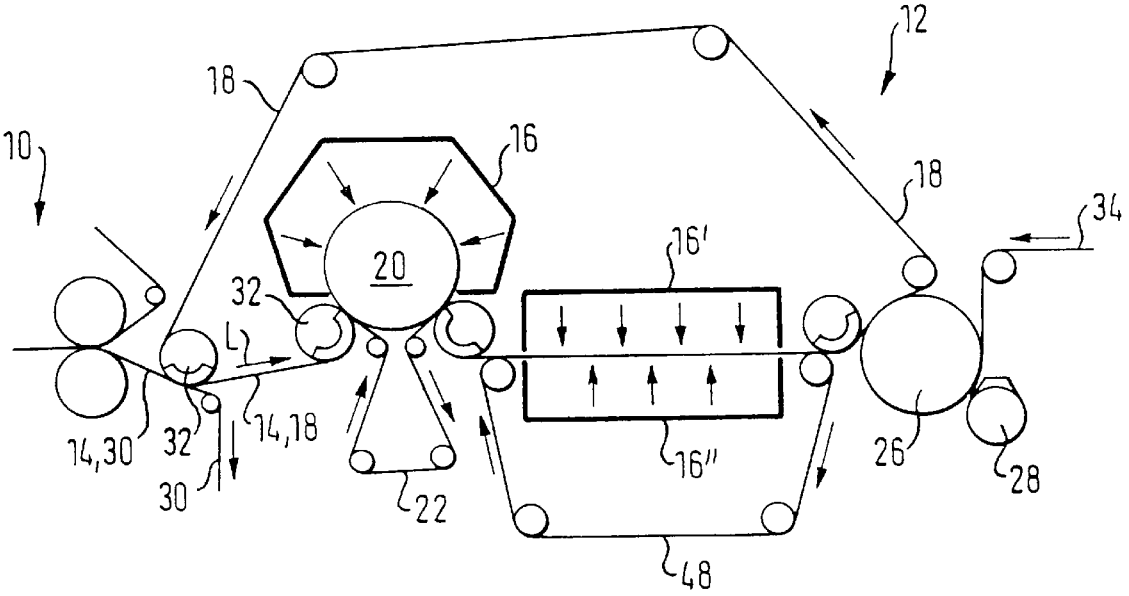
FIG. 9 shows a ninth embodiment of a drying end having one impact flow drier positioned opposite a large support roll and two impact flow driers positioned opposite each other arranged downstream therefrom for bilateral bombardment of the material web.

FIG. 9 shows a ninth embodiment of a drying end 14 where, after the press section 10, the material web 14 is first guided by a large support roll 20 surrounded by a bottom wire 22 positioned below the web for one-surfaced drying. An impact flow drier 16 positioned above the web dries one surface thereof. The web is then linearly guided for two-surfaced drying between two intermediate impact flow driers 16', 16" positioned one above the other. Between the two impact flow driers 16', 16" that are used for bilateral drying, the material web 14 is guided therebetween along with the cover wire 18 and another wire belt 48, the cover wire also being guided over the support roll.

After transferring from the press section 10 and drying on the large support roll 20 by the impact flow drier 16, the material web 14 is dried simultaneously from both surfaces in a linear zone, which may, for example, be slightly curved, by two impact flow driers 16', 16" positioned one above the other, for example, to a solids content of approximately 55% to approximately 70%. A single drier surrounding the material web and acting on both web surfaces may also be provided for bilateral drying. The material web 14 is supported by at least a fabric such that it never has to be removed from a smooth surface. Then, the material web 14 is fed to a drier group having a plurality of drying cylinders 26 with associated suction rolls 28.

In the present embodiment, the cover wire 18 is also guided through the zone between the two impact flow driers 16', 16" positioned one above the other. The additional wire belt 48 functions as a support wire. The material web 14 may also be transferred to two new wires. On the side of the web facing the wire belt 48, a plurality of support rolls may be provided. In the present embodiment, a one-row drying group having a plurality of drying cylinders 26 and suction rolls 28 is provided. A two-row drying group may be used in alternative embodiments.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A drying end of a machine for the production of a material web, the material web having a top surface and a botton surface, the drying end comprising:

at least one impact flow drier configured to bombard at least one surface of the material web with at least one of hot air hot steam impact flow, wherein a temperature of the at least one of hot air hot steam impact flow is at least approximately 150° C.

2. The drying end according to claim 1, further comprising an open support surface over which the material web is guided by the surface opposite the surface bombarded with the impact flow.

3. The drying end according to claim 1, further comprising a steam suction device provided on at least one of said at least one impact flow drier, the impact flow dried being configured to simultaneously dry the material web and remove steam.

4. The drying end according to claim 2, further comprising a cover wire positioned between the material web and said at least one impact flow drier, wherein said cover wire and the material web are adapted to be guided together over said support surface.

5. The drying end according to claim 2, further comprising a support roll over which the material web is adapted to be guided, and wherein said open support surface comprises one of the surface of said support roll, a covering over said support roll, a coating of said support roll and a continuous belt adapted to be guided over said support roll.

6. The drying end according to claim 5, wherein said support roll has an external diameter in the range from approximately 2 meters to approximately 10 meters.

7. The drying end according to claim 5, wherein said open support surface comprises a surface of a continuous belt adapted to be guided over said support roll, said continuous belt comprising an air-permeable wire.

8. The drying end according to claim 5, wherein said open support surface comprises a surface of a continuous belt adapted to be guided over said support roll, said continuous belt comprising an air-impermeable transport belt.

9. The drying end according to claim 5, wherein said open support surface comprises a shrink wire installed on the support roll.

10. The drying end according to claim 5, wherein said support roll has one of a solid sleeve design and a spoke/lattice design.

11. The drying end according to claim 2, wherein said open support surface comprises a surface of a support belt, said support belt configured to be guided over a plurality of support rolls.

12. The drying end according to claim 11, wherein said support rolls are arranged in an arc.

13. The drying end according claim 11, wherein said support belt is configured to be guided in the shape of a polygon.

14. The drying end according to claim 5, wherein said support rolls lie in one of a plane and a curve.

15. The drying end according to claim 2, wherein said open support surface is divided into a plurality of sections, each said section being flat.

16. The drying end according to claim 11, wherein said support belt is constructed of one of metal and plastic.

17. The drying end according to claim 11, wherein said support belt is air-impermeable.

18. The drying end according to claim 17, wherein said support belt is constructed of an air-impermeable fabric.

19. The drying end according to claim 4, wherein said cover wire is constructed of one of metal and plastic.

20. The drying end according to claim 2, wherein said support surface further comprises a removal zone, said support surface being adapted to bombard the material web with compressed air through the support surface at least in said removal zone, whereby the web may be removed from the support surface.

21. The drying end according to claim 1, further comprising a support roll comprising one of perforations and a lattice structure, said support roll adapted to guide the material web thereover, said support roll further adapted for bombardment on the inside thereof with compressed air.

22. The drying end according to claim 21, wherein said support roll further comprises a removal zone, and said support roll is adapted for bombardment on the inside thereof at least at said removal zone, whereby the web may be removed from the support roll.

23. The drying end according to claim 22, further comprising a cover wire positioned between the material web and said at least one impact flow drier, wherein said cover wire and the material web are adapted to be guided together over said support surface, whereby the web and said cover wire may be removed from the support roll.

24. The drying end according to claim 20, wherein the temperature of the compressed air is higher than approximately 20° C.

25. The drying end according to claim 1, wherein said at least one of hot air and hot steam impact flow has a temperature in the range from approximately 150° C. to approximately 450° C., and is further adapted to be generated by at least one of said at least one impact flow drier.

26. The drying end according to claim 1, wherein at least one of said at least one impact flow drier comprises a plurality of nozzles.

27. The drying end according to claim 1, wherein at least one of said at least one impact flow drier comprises at least one drier hood.

28. The drying end according to claim 1, further comprising at least two support rolls positioned in series in the direction of web travel, each said support roll being operatively arranged with a respective said impact flow drier.

29. The drying end according to claim 28, wherein each of said at least two support rolls has a different diameter.

30. The drying end according to claim 1, wherein at least one of said at least one impact flow drier has a drier hood, said drier hood being subdivided into zones according to at least one of a direction of web travel and right angles to a direction of web travel.

31. The drying end according to claim 26, wherein each said nozzle has a fixed and identical distance from the material web during operation.

32. The drying end according to claim 31, wherein the distance of each said nozzle from the material web is in the range from approximately 10 mm to approximately 50 mm.

33. The drying end according to claim 1, wherein the flow speed of said at least one of hot air and hot steam impact flow is in the range from approximately 60 meters/second to approximately 120 meters/second.

34. The drying end according to claim 2, wherein at least one of said at least one impact flow drier is positioned above the material web and is operatively arranged with a respective said support surface positioned below the material web.

35. The drying end according to claim 2, wherein at least one of said at least one impact flow drier is positioned below the material web and is operatively arranged with a respective said support surface positioned above the material web.

36. The drying end according to claim 1, wherein the material web is adapted to be simultaneously bombarded on both surfaces in at least one zone by a respective said at least one of hot air and hot steam impact flow.

37. The drying end according to claim 36, wherein the material web is adapted to be guided through said at least one zone between two wire belts.

38. The drying end according to claim 36, wherein the material web is adapted to be guided through said at least one zone by one of along a linear and curved path.

39. The drying end according to claim 36, wherein at least one said wire belt is guided over a plurality of support rolls.

40. The drying end according to claim 39, wherein said plurality of support rolls lie in one of a single plane and a curved surface.

41. The drying end according to claim 37, wherein at least one said wire belt is constructed of one of metal and plastic.

42. The drying end according to claim 1, further comprising a starting zone, wherein at least one of said at least one impact flow drier is provided in the starting zone.

43. The drying end according to claim 1, further comprising:

at least one drying group comprising at least one drying cylinder;

wherein:

at least one of said at least one impact flow drier is located upstream of said at least one drying group in a direction of web travel; and the material web has a solids content which is greater than approximately 55% to approximately 70% upon reaching said at least one drying cylinder.

44. The drying end according to claim 1, further comprising at least one of at least one one-row drying group and at least one two-row drying group.

45. The drying end according to claim 1, further comprising an end zone, wherein at least one of said at least one impact flow drier is provided in said end zone.

46. The drying end according to claim 1, further comprising an evaporation zone, wherein at least one of at least one impact flow drier is provided in the evaporation zone.

47. The drying end according to claim 1, wherein said at least one impact flow drier is at least two impact flow driers positioned in series in a direction of web travel, said at least two impact flow driers being configured to bombard the material web from opposite web surfaces with said at least one of hot air and hot steam impact flow.

48. The drying end according to claim 1, wherein said at least one impact flow drier is at least two impact flow driers positioned in series in a direction of web travel, said at least two impact flow driers being configured to bombard the material web from one web surface with said at least one of hot air and hot steam impact flow.

49. The drying end according to claim 1, further comprising at least two intermediate impact flow driers positioned opposite each other and configured to bombard the material web from opposite surfaces.

50. The drying end according to claim 47, further comprising at least one intermediate impact flow drier configured to bombard the material web from opposite web surfaces with said at least one of hot air and hot steam impact flow, said at least one intermediate impact flow drier being positioned intermediate said at least two impact flow driers.

51. The drying end according claim 48, further comprising at least one intermediate impact flow drier configured to bombard the material web from opposite web surfaces with said at least one of hot air and hot steam impact flow, said at least one intermediate impact flow drier being positioned intermediate said at least two impact flow driers.

52. The drying end according to claim 1, further comprising at least one group of three sequentially-positioned impact flow drier units, at least one said unit being an opposing impact flow drier, wherein the material web is adapted to be guided through said at least one group along a first arc, one of a plane and a curved surface, and along a second arc.

53. The drying end according to claim 1, wherein said at least one impact flow drier is a plurality of impact flow driers sequentially positioned in a web travel direction, said plurality of impact flow driers being adapted to alternatingly bombard opposite surfaces of the material web.

54. The drying end according to claim 1 in particular, wherein the material web is one of paper and cardboard.

55. A method for drying a material web comprising:

bombarding the material web on at least one surface with at least one of hot air and hot steam impact flow, via at least one impact flow drier, wherein a temperature of the at least one of hot air and hot steam impact flow is at least approximately 150° C.

56. The method according to claim 55, further comprising guiding the material web over an open support surface by the surface of the material web opposite the surface bombarded with the impact flow.

57. The method according to claim 55, further comprising simultaneously drying the material web and removing steam via a steam suction device provided on at least one impact flow drier.

58. The method according to claim 56, further comprising guiding the material web over the support surface together with a cover wire positioned between the material web and the at least one impact flow drier.

59. The method according to claim 56, further comprising guiding the material web over a support roll, and wherein the open support surface comprises one of the surface of the support roll, a covering over the support roll, a coating of the support roll and a continuous belt that is guided over the support roll.

60. The method according to claim 59, wherein the support roll has an external diameter in the range from approximately 2 meters to approximately 10 meters.

61. The method according to claim 59, wherein the open support surface comprises a surface of a continuous belt, the method further comprising guiding the continuous belt over the support roll, the continuous belt comprising an air-permeable wire.

62. The method according to claim 59, wherein the open support surface comprises a surface of a continuous belt, the method further comprising guiding the continuous belt over the support roll, the continuous belt comprising an air-impermeable transport belt.

63. The method according to claim 59, wherein the open support surface comprises a shrink wire installed on the support roll.

64. The method according to claim 59, wherein the support roll has one of a solid sleeve design and a spoke/lattice design.

65. The method according to claim 56, wherein the open support surface comprises a surface of a support belt, the method further comprising guiding the continuous belt over a plurality of support rolls.

66. The method according to claim 65, further comprising arranging the support rolls in an arc.

67. The method according claim 65, further comprising guiding the support belt in the shape of a polygon.

68. The method according to claim 59, wherein the support rolls lie in one of a plane and a curve.

69. The method according to claim 56, wherein the open support surface is divided into a plurality of sections, each section being flat.

70. The method according to claim 65, wherein the support belt is constructed of one of metal and plastic.

71. The method according to claim 65, wherein the support belt is air-impermeable.

72. The method according to claim 71, wherein the support belt is constructed of an air-impermeable fabric.

73. The method according to claim 58, wherein the cover wire is constructed of one of metal and plastic.

74. The method according to claim 56, further comprising:

bombarding the material web with compressed air through the support surface at least in a removal zone; and removing the web from the support surface.

75. The method according to claim 55, further comprising:

guiding the material web over a support roll, the support roll having one of perforations and a lattice structure; and bombarding the support roll from the inside with compressed air, at least in zones.

76. The method according to claim 75, further comprising:

bombarding the support roll with compressed air, at least in a removal zone; and removing the web from the support roll.

77. The method according to claim 76, further comprising:

guiding a cover wire and the material web together over the support surface, the cover wire positioned between the material web and the at least one impact flow drier; and removing the web and cover wire from the support roll.

78. The method according to claim 74, wherein the temperature of the compressed air is higher than approximately 20° C.

79. The method according to claim 55, further comprising generating the at least one of hot air and hot steam impact flow having a temperature in the range from approximately 150° C. to approximately 450° C.

80. The method according to claim 55, wherein at least one of the at least one impact flow drier includes a plurality of nozzles.

81. The method according to claim 55, wherein at least one of the at least one impact flow drier includes at least one drier hood.

82. The method according to claim 55, further comprising:

positioning at least two support rolls in series in the direction of web travel; and operatively arranging each support roll with a respective impact flow drier.

83. The method according to claim 82, wherein each of the at least two support rolls has a different diameter.

84. The method according to claim 55, wherein at least one of the at least one impact flow drier has a drier hood, the drier hood being subdivided into zones according to at least one of a direction of web travel and right angles to a direction of web travel.

85. The method according to claim 80, wherein each nozzle has a fixed and identical distance from the material web during operation.

86. The method according to claim 85, wherein the distance of each nozzle from the material web is in the range from approximately 10 mm to approximately 50 mm.

87. The method according to claim 55, wherein the flow speed of the at least one of hot air and hot steam impact flow is in the range from approximately 60 meters/second to approximately 120 meters/second.

88. The method according to claim 56, further comprising:

positioning at least one impact flow drier above the material web; and operatively arranging the at least one impact flow drier with a respective support surface positioned below the material web.

89. The method according to claim 56, further comprising:

positioning at least one impact flow drier below the material web; and operatively arranging the at least one impact flow drier with a respective support surface positioned above the material web.

90. The method according to claim 55, further comprising simultaneously bombarding both surfaces of the material web in at least one zone by a respective at least one of hot air and hot steam impact flow.

91. The method according to claim 90, further comprising guiding the material web through the at least one zone between two wire belts.

92. The method according to claim 90, further comprising guiding the material web through the at least one zone by one of along a linear and curved path.

93. The method according to claim 90, further comprising guiding at least one wire belt over a plurality of support rolls.

94. The method according to claim 93, wherein the plurality of support rolls lie in one of a plane and a curve.

95. The method according to claim 91, wherein at least one wire belt is constructed of one of metal and plastic.

96. The method according to claim 55, further comprising providing at least one of the at least one impact flow drier in a starting zone.

97. The method according to claim 55, further comprising positioning at least one of the at least one impact flow drier upstream of at least one drying group in a direction of web travel, wherein the material web has a solids content which is greater than approximately 55% to approximately 70% upon reaching the at least one drying cylinder.

98. The method according to claim 55, further comprising providing at least one of at least one one-row drying group and at least one two-row drying group.

99. The method according to claim 55, further comprising providing at least one of the at least one impact flow drier in an end zone.

100. The method according to claim 55, further comprising providing an impact flow drier in an evaporation zone.

101. The method according to claim 55, further comprising:

positioning in series at least two impact flow driers in a direction of web travel; and bombarding, by the at least two impact flow driers, the material web from opposite web surfaces with the at least one of hot air and hot steam impact flow.

102. The method according to claim 55, further comprising:

positioning in series at least two impact flow driers in a direction of web travel bombarding, by the at least two impact flow driers, the material web from the same web surface with the at least one of hot air and hot steam impact flow.

103. The method according to claim 55, further comprising:

positioning at least two intermediate impact flow driers opposite each other; and bombarding the material web from opposite web surfaces.

104. The method according to claim 101, further comprising:

positioning at least one intermediate impact flow drier between the at least two impact flow driers; and bombarding the material web from opposite web surfaces by the at least one intermediate impact flow drier with the at least one of hot air and hot steam impact flow.

105. The method according claim 102, further comprising:

positioning at least one intermediate impact flow drier intermediate the at least two impact flow driers; and bombarding the material web from opposite web surfaces by the at least one intermediate impact flow drier with the at least one of hot air and hot steam impact flow.

106. The method according to claim 55, further comprising:

guiding the material web through at least one group along a first arc, each group having three sequentially-positioned impact flow driers, at least one of which is an opposing impact flow drier;

guiding the material web through one of a plane and a curved surface; and guiding the material web along a second arc.

107. The method according to claim 55, further comprising:

sequentially positioning a plurality of impact flow driers in a web travel direction; and alternatingly bombarding, by the plurality of impact flow driers, opposite surfaces of the material web.

108. The method according to claim 55 in particular, wherein the material web is one of paper and cardboard.

109. A drying end of a machine for the production of a material web, the material web having a top surface and a bottom surface, the drying end comprising:

an impact flow drier configured to bombard the top surface of the material web with at least one of hot air and hot steam impact flow;

a support roll operatively arranged below said impact flow drier;

a cover wire adapted to cover the top surface of said material web during bombardment; and a continuous belt having an open support surface over which the material web is guided, said continuous belt adapted to be guided about said support roll with the material web between said continuous belt and cover wire during bombardment, wherein a temperature of the at least one of hot air and hot steam impact flow is at least approximately 150° C.

110. A drying end of a machine for the production of a material web, the material web having a top surface and a bottom surface, the drying end comprising:

a first impact flow drier configured to bombard the top surface of the material web with at least one of hot air and hot steam impact flow;

a first support roll operatively arranged below said impact flow drier;

a first cover wire adapted to cover the top surface of said material web during bombardment;

a first continuous belt having an open support surface over which the material web is guided, said continuous belt adapted to be guided about said support roll with the material web between said first continuous belt and said first cover wire during bombardment;

a second impact flow drier configured to bombard the bottom surface of the material web with at least one of hot air and hot steam impact flow, said second impact flow drier positioned downstream of said first impact flow drier, in a direction of web travel;

a second support roll operatively arranged above said second impact flow drier;

a second cover wire adapted to cover the bottom surface of said material web during bombardment; and a second continuous belt having an open support surface over which the material web is guided, said second continuous belt adapted to be guided about said second support roll with the material web between said second continuous belt and said second cover wire during bombardment.

111. A drying end of a machine for the production of a material web, the material web having a top surface and a bottom surface, the drying end comprising:

a first impact flow drier configured to bombard the bottom surface of the material web with at least one of hot air and hot steam impact flow;

a first support roll operatively arranged above said impact flow drier;

a first cover wire adapted to cover the bottom surface of said material web during bombardment;

a first continuous belt having an open support surface over which the material web is guided, said continuous belt adapted to be guided about said support roll with the material web between said first continuous belt and said first cover wire during bombardment;

a second impact flow drier configured to bombard the top surface of the material web with at least one of hot air and hot steam impact flow, said second impact flow drier positioned downstream of said first impact flow drier, in a direction of web travel;

a second support roll operatively arranged below said second impact flow drier;

a second cover wire adapted to cover the top surface of said material web during bombardment; and a second continuous belt having an open support surface over which the material web is guided, said second continuous belt adapted to be guided about said second support roll with the material web between said second continuous belt and said second cover wire during bombardment.

112. A drying end of a machine for the production of a material web, the material web having a top surface and a bottom surface, the drying end comprising:

a first impact flow drier configured to bombard the top surface of the material web with at least one of hot air and hot steam impact flow;

a first support roll operatively arranged below said impact flow drier;

a first continuous belt having an open support surface over which the material web is guided;

a second impact flow drier configured to bombard the top surface of the material web with at least one of hot air and hot steam impact flow, said second impact flow drier positioned downstream of said first impact flow drier, in a direction of web travel;

a second support roll operatively arranged below said second impact flow drier;

a second continuous belt having an open support surface over which the material web is guided a cover wire adapted to cover the top surface of said material web during bombardment and during travel between both said support rolls, and guided about said first and said second support rolls, with the material web between said first continuous belt and said cover wire during bombardment by said first impact flow drier, and with the material web between said second continuous belt and said cover wire during bombardment by said second impact flow drier.

113. A drying end of a machine for the production of a material web, the material web having a top surface and a bottom surface, the drying end comprising:

an impact flow drier configured to bombard the top surface of the material web with at least one of hot air and hot steam impact flow;

a plurality of support rolls operatively arranged below said impact flow drier and arranged in an arc;

a cover wire adapted to cover the top surface of said material web during bombardment; and a continuous belt having an open support surface over which the material web is guided, said continuous belt adapted to be guided about said plurality of support rolls with the material web between said continuous belt and cover wire during bombardment.

114. A drying end of a machine for the production of a material web, the material web having a top surface and a bottom surface, the drying end comprising:

a plurality of impact flow driers configured to bombard the top surface of the material web with at least one of hot air and hot steam impact flow, said plurality of impact flow driers sequentially positioned along a of web travel direction;

a plurality of support rolls operatively arranged below said impact flow drier;

a cover wire adapted to cover the top surface of said material web during bombardment;

a common support belt having an open support surface over which the material web is guided, said common support belt adapted to be guided about said plurality of support rolls with the material web between said continuous belt and said cover wire during bombardment.

115. A drying end of a machine for the production of a material web, the material web having a top surface and a bottom surface, the drying end comprising:

a first impact flow drier configured to bombard the top surface of the material web with at least one of hot air and hot steam impact flow;

a first latticed support roll operatively arranged below said first impact flow drier and coated with a shrink wire over which the material web is guided, and further having an internal blast chamber;

a second impact flow drier configured to bombard the top surface of the material web with at least one of hot air and hot steam impact flow, said second impact flow drier positioned downstream of said first impact flow drier, in a direction of web travel;

a second latticed support roll operatively arranged below said second impact flow drier and coated with a shrink wire over which the material web is guided, and further having an internal blast chamber;

a top intermediate impact flow drier and a bottom intermediate impact flow drier positioned one above the other and adapted to bombard both surfaces of the material web, said top and bottom intermediate impact flow driers positioned between said first and second latticed support rolls;

a cover wire adapted to cover the top surface of said material web during bombardment and during travel between both said support rolls, and guided about said first and said second latticed support rolls, with the material web between said first latticed support roll and said cover wire during bombardment by said first impact flow drier, with the material web between a wire belt and said cover wire during bombardment by said intermediate impact flow driers, and with the material web between said second latticed support roll and said cover wire during bombardment by said second impact flow drier.

116. A drying end of a machine for the production of a material web, the material web having a top surface and a bottom surface, the drying end comprising:

a first impact flow drier configured to bombard the bottom surface of the material web with at least one of hot air and hot steam impact flow;

a first latticed support roll operatively arranged above said first impact flow drier and coated with a shrink wire over which the material web is guided, and further having an internal blast chamber;

a second impact flow drier configured to bombard the bottom surface of the material web with at least one of hot air and hot steam impact flow, said second impact flow drier positioned downstream of said first impact flow drier, in a direction of web travel;

a second latticed support roll operatively arranged above said second impact flow drier and coated with a shrink wire over which the material web is guided, and further having an internal blast chamber;

a top intermediate impact flow drier adapted to bombard the top surface of the material web and positioned between said first and second latticed support rolls;

a plurality of support rolls arranged in an arc below said top intermediate impact flow drier;

a cover wire adapted to cover the top surface of said material web during bombardment and during travel between both said support rolls, and guided about said first and said second latticed support rolls, with the material web between said first latticed support roll and said cover wire during bombardment by said first impact flow drier, with the material web between a wire belt and said cover wire during bombardment by said top intermediate impact flow drier, and with the material web between said second latticed support roll and said cover wire during bombardment by said second impact flow drier.

117. A drying end of a machine for the production of a material web, the material web having a top surface and a bottom surface, the drying end comprising:

an impact flow drier configured to bombard the top surface of the material web with at least one of hot air and hot steam impact flow;

a support roll operatively arranged below said impact flow drier;

a continuous belt having an open support surface over which the material web is guided, said continuous belt adapted to be guided about a portion of said support roll;

a top intermediate impact flow drier and a bottom intermediate impact flow drier positioned one above the other and adapted to bombard both surfaces of the material web, said top and bottom intermediate impact flow driers positioned downstream of said support roll in a direction of web travel; and a cover wire adapted to cover the top surface of said material web during bombardment by said impact flow drier and said intermediate flow driers, and guided about a portion of said support roll, with the material web between said continuous belt and said cover wire during bombardment by said impact flow drier, and with the material web between a wire belt and said cover wire during bombardment by said intermediate impact flow driers.

118. The drying end in accordance with claim 1, wherein a flow speed of the at least one of hot air and hot steam impact flow is at least approximately 60 m/s.

119. The drying end in accordance with claim 1, further comprising an open support surface and a cover wire, wherein the open support and the cover wire are arranged to sandwich the material web and to guide the material web past the at least one impact flow drier.

120. The method in accordance with claim 55, wherein a flow speed of the at least one of hot air and hot steam impact flow is at least approximately 60 m/s.

121. The method in accordance with claim 55, further comprising guiding an open support and a cover wire past the at least one impact flow drier, wherein the material web is sandwiched between the open support and the cover wire past the at least one impact flow drier.

122. The drying end in accordance with claim 109, wherein a flow speed of the at least one of hot air and hot steam impact flow is at least approximately 60 m/s.

* * * * *